US007358017B2

(12) United States Patent
Reeves et al.

(10) Patent No.: US 7,358,017 B2
(45) **Date of Patent: *Apr. 15, 2008**

(54) PHOTOCONDUCTOR WITH CERAMER OVERCOAT

(75) Inventors: Scott Daniel Reeves, Louisville, CO (US); Edward Wayne Weidert, Superior, CO (US)

(73) Assignee: Lexmark International, Inc., Lexington, KY (US)

( * ) Notice: Subject to any disclaimer, the term of this patent is extended or adjusted under 35 U.S.C. 154(b) by 410 days.

This patent is subject to a terminal disclaimer.

(21) Appl. No.: 11/144,925

(22) Filed: Jun. 3, 2005

(65) Prior Publication Data

US 2006/0275684 A1 Dec. 7, 2006

(51) Int. Cl.
*G03G 5/147* (2006.01)

(52) U.S. Cl. ..... 430/66; 430/67

(58) Field of Classification Search ..... 430/66, 430/67

See application file for complete search history.

(56) References Cited

U.S. PATENT DOCUMENTS

| | | | |
|---|---|---|---|
| 3,944,520 | A | 3/1976 | Andrianov et al. |
| 4,027,073 | A | 5/1977 | Clark |
| 4,278,804 | A | 7/1981 | Ashby et al. |
| 4,439,509 | A | 3/1984 | Schank |
| 4,443,579 | A | 4/1984 | Doin et al. |
| 4,477,499 | A | 10/1984 | Doin et al. |
| 4,559,271 | A | 12/1985 | Doin et al. |
| 4,565,760 | A | 1/1986 | Schank |
| 4,595,602 | A | 6/1986 | Schank |
| 4,606,934 | A | 8/1986 | Lee et al. |
| 4,912,000 | A | 3/1990 | Kumakura et al. |
| 4,917,980 | A | 4/1990 | Badesha et al. |
| 4,923,775 | A | 5/1990 | Schank |
| 5,731,117 | A | 3/1998 | Ferrar et al. |
| 5,783,651 | A | 7/1998 | Konig et al. |
| 5,874,018 | A | 2/1999 | Ferrar et al. |
| 5,882,830 | A | 3/1999 | Visser et al. |
| 5,910,272 | A | 6/1999 | Kusnibiki et al. |
| 5,968,656 | A | 10/1999 | Ezenyilimba et al. |
| 6,074,756 | A | 6/2000 | Vreeland et al. |
| 6,194,106 | B1 | 2/2001 | Bretscher et al. |
| 6,299,799 | B1 | 10/2001 | Craig et al. |
| 6,489,069 | B1 | 12/2002 | Itami et al. |
| 7,238,456 | B2 | 7/2007 | Bender et al. |
| 2003/0044407 | A1 | 3/2003 | Chang et al. |
| 2003/0195283 | A1 | 10/2003 | Lee et al. |
| 2003/0199620 | A1 | 10/2003 | Lee et al. |
| 2004/0121251 | A1* | 6/2004 | Yokota et al. ..... 430/58.45 |

FOREIGN PATENT DOCUMENTS

| | | | |
|---|---|---|---|
| EP | 1 380 596 | * | 1/2004 |
| JP | 02-187437 | | 7/1990 |

OTHER PUBLICATIONS

U.S. Appl. No. 11/103,015, pending, Reeves.
Notice of Allowance—date mailed Nov. 2, 2007—issued in co-pending U.S. Appl. No. 11/103,015, filed Apr. 11, 2002 (published Oct. 12, 2006 as No. 20060228638) (4 pgs).

* cited by examiner

*Primary Examiner*—John L Goodrow
(74) *Attorney, Agent, or Firm*—John A. Brady

(57) ABSTRACT

A polyurethane-silica hybrid, or polyurethane-silica/silsesquioxane hybrid overcoat improves the life of the photoconductor drum without significantly altering the electrophotographic properties of the PC drum. Wear can be caused by a variety of factors, which include contact with the cleaner blade, paper, or intermediate transfer member or by erosion or scratching from toner components. The combination of hard and soft segments allows for a tough, wear resistant material with the added flexibility to prevent erosion from toner particles that are swept along the surface of the drum by the cleaner blade. A benzophenone ultraviolet absorber chemically linked to the silsesquioxane appears to inhibit room light fatigue and improve the electrostatic cycling of the PC drum. The overcoat also inhibits crazing.

13 Claims, No Drawings

PHOTOCONDUCTOR WITH CERAMER OVERCOAT

RELATED APPLICATION

One inventor of this application is the sole inventor of U.S. patent application Ser. No. 11/103,015, filed Apr. 2005, which is to a photoconductor (PC) coating of the silsesquioxane substituted with a hydrolyzed benzophonone employed in embodiments in this application as a ceramer element. Both that application and this application were invented while all inventors were subject to obligation to assign the invention to their same employer, which is the assignee of both applications.

TECHNICAL FIELD

The present invention improves the wear and erosion and other properties of a photoreceptor or photoconductor (PC) drum by utilizing a ceramer overcoat on top of the photoreceptor layers.

BACKGROUND OF THE INVENTION

The overcoat on a photoconductor can improve wear and erosion resistance, can mitigate crazing, and can lower the negative fatigue of the photoconductor drum. While numerous photoconductor overcoat patents exist in the prior art, none define a hybrid organic-inorganic ceramer protective overcoat that provides both wear resistance and inhibition of crazing phenomenon while having exceptional mobility (electrical stability) as wear progresses.

In electrophotography, a dual layer photoconductor or photoreceptor is comprised of a charge generation layer (CGL) and charge transport layer (CTL) coated onto a suitable substrate, such as aluminized MYLAR polyester or an anodized aluminum drum. The CGL is designed for the photogeneration of charge carriers and is comprised of pigments or dyes, such as azo compounds, perylenes, phthalocyanines, squaraines, for example, with or without a polymer binder. The CTL layer, as its name implies, is designed to transport the generated charges. The CTL contains charge transport molecules, which are organic materials capable of accepting and transporting charge, such as hydrazones, tetraphenyl diamines, triaryl amines, for example.

Typically, the CTL also contains polymer binders, which are present to provide a wear resistant surface. Moreover, the polymer binders create adhesion between the layers and give a smooth surface, which can be easily cleaned.

As printers are made to perform at faster and faster print speeds, very short charge and discharge intervals are required. These faster speeds put increasingly greater demands on the PC drum and can shorten their effective useful life. In addition, the demand for smaller printer footprints puts additional constraints on the PC drum design. The PC drum may also be exposed to room light during servicing, which can cause fatigue in the PC drum.

Fatigue corresponds to the change in voltage over the life of the drum. In addition to fatigue from room light, fatigue can also result from drum cycling (repeated charge/discharge cycles) or from exposure to UV radiation, such as that emitted from a corona discharge lamp. Positive fatigue corresponds to photoconductor drums that discharge at lower voltages. For example, if a drum initially discharges to −100V, and on cycling or after exposure to room light discharges to −50V, the drum is exhibiting a positive fatigue of +50V. This positive fatigue would result in darker prints compared to the initial ones. Similarly, negative fatigue corresponds to a drum exhibiting a discharge voltage that is higher than the initial and would result in lighter prints.

Therefore, controlling the drum fatigue is important for the reproducibility of prints. The PC drum may also be more accessible to possible contamination from the environment or the user during routine maintenance. Furthermore, if smaller diameter drums are required because of space constraints, wear issues are magnified since more revolutions of the drum are required to print a page.

Silsesquioxanes have been incorporated into photoconductors as resin binders because of their abrasion resistant properties. Silsesquioxanes are compounds with the empirical chemical formula, $RSiO_{1.5}$, and can be thought of as hybrid intermediate between silica ($SiO_2$) and silicone ($R_2SiO$). Sol-gel precursors are formed by the hydrolysis of trialkoxysilanes, which are cured to a mixed cage/network, or silsesquioxane structure.

When cured at higher temperatures, part of the cage structure is transformed into a more cross-linked network structure. Because of their cross-linked network structure, these materials are hard and have useful applications as abrasion resistant coatings, which include overcoats for organic photoconductor layers. Silsesquioxane layers are harder and less permeable to chemical contaminants than typical PC layers or binders such as polyesters or polycarbonates. Furthermore, these materials are known for low surface energy, which should make them good as release coatings to aid in toner transfer.

Silsesquioxane overcoats possess many other properties that are also advantageous for photoconductors. Because of their smooth surface, silsesquioxane overcoats are expected to increase the efficiency of particle transfer from the photoconductor surface, which is increasingly important as toner particle size decreases to meet the demands of higher image resolution. In addition to their smooth and hard features, these materials can also provide protection from physical, chemical, and radiation damage. For instance, the addition of acid scavengers to keep contaminants, such as acids, from reaching the photoreceptor surface. Likewise, dyes can be added to protect the photoreceptor from fatigue, especially from room light.

Likewise, polyurethanes are well known as protective layers, for example, as hard furniture finishes. Polyurethanes are made by the reaction of polyols with multi-functional isocyanates. This broad class of polymers offers many desirable properties for photoconductor applications such as toughness, hardness, and abrasion resistance. By adding flexible polyether glycol segments between urethane linkages, softer polyurethanes can be made that are both flexible and durable. Furthermore, the combination of these soft polyurethane materials with hard silica and/or silsesquioxane materials into a hybrid organic-inorganic material allows for a hard yet flexible material with high wear resistance.

To address these issues to achieve a long life PC drum, a protective top layer can be coated onto the photoconductor drum. The protective overcoat can include additives that protect against damage from handling, exposure to UV light, and from the abrasion and erosion caused from the toner, cleaner blade, charge roll, for example.

While a robust overcoat can improve the life of the PC drum, a suitable overcoat is required that does not significantly alter the electrophotographic properties of the PC drum. If the layer is too electrically insulating, the photoconductor will not discharge and will result in a poor latent image. On the other hand, if the layer is too electrically conducting, then the electrostatic latent image will spread resulting in a blurred image. Thus, a protective layer that improves the life of the photoconductor must not negatively alter the electrophotographic properties of the PC drum.

DISCLOSURE OF THE INVENTION

This invention employs a polyurethane-silica hybrid, or polyurethane-silica/silsesquioxane hybrid overcoat to improve the life of the photoconductor drum without significantly altering the electrophotographic properties of the PC drum. This major development includes the improvement of the wear and erosion properties of the PC drum resulting in a PC drum with much longer life. Wear can be caused by a variety of factors, which include contact with the cleaner blade, paper, or intermediate transfer member (ITM) or by erosion or scratching from toner components.

The increased robustness of the PC drum is due to the cross-linked hybrid polyurethane-silica structure, which is much tougher and harder than the polyester or polycarbonate charge transport layer. The combination of hard and soft segments allows for a tough, wear resistant material with the added flexibility to prevent erosion from toner particles that are swept along the surface of the drum by the cleaner blade.

In addition, the presence of an ultraviolet absorber, a benzophenone, chemically linked to the material, appears to inhibit room light fatigue and improve the electrostatic cycling of the PC drum. The overcoat also inhibits crazing as exemplified by inhibiting oils or lotions from reaching the CT layer during drum handling. In crazing, small microcracks form in a direction perpendicular to the applied stress.

The thickness of the overcoat of the ceramer hybrid material may be 0.1 to 5 microns, more preferably about 0.5 to 2 microns, and most preferably about 1.5 microns.

DESCRIPTION OF THE PREFERRED EMBODIMENTS

A polyurethane prepolymer was prepared according to Example 1 in U.S. Pat. No. 5,968,656. 100.2 g of TERATHANE® 2900 polyether glycol (0.035 mol) was mixed with 4.94 g (0.055 mol) of 1,4-butanediol and 1.52 g (0.011 mol) of trimethylolpropane (TMP) in 300 g of tetrahydrofuran (THF) with stirring under nitrogen gas. To the solution, 19.9 g (0.090 mol) of isophorone diisocyanate followed by 0.0125 g (0.020 mmol) of dibutyltin dilaurate in 2 mL of THF was added. Then, the mixture was heated to 60° C. for 6 hours. Then, 9.93 g (0.040 mol) of 3-(triethoxysilyl)propyl isocyanate in 130 g of THF was added and the solution was stirred overnight at 60° C. (16 hours).

EXAMPLE 1

To prepare the hybrid organic-inorganic formulation, 180.0 g of 2-propanol and 175.6 g (0.84 mol) of tetraethyl orthosilicate was added to 200.27 g of the prepared urethane prepolymer described above. Then, 10.0 mL of 37% hydrochloric acid was diluted with 55.7 mL of deionized water and added to the reaction mixture. The solution was stirred for 2 days at room temperature. 200.4 g of the mixture was diluted with 200.4 g of 2-propanol. Finally, 0.2 g of BYK-310 silicone flow promoter from BYK-Chemie was added. A photoconductor drum consisting of a CTL over a CGL on an anodized A1 core was then coated with the above solution and cured at 100° C. for 1 hour. An eddy current test system was used to measure the film thickness to be 1.5 μm.

The overcoat drum was then tested in a LEXMARK C750 color laser printer. The drum, tested in a two page and pause mode, showed good print quality with negligible PC wear over 30,000 prints. The drum showed minimal wear and little or no change in film thickness. The wear was determined to be 0.01 μm per 1000 pages. This compares very favorable to a control drum without the overcoat layer (identical CG and CT layers), where the wear rate was determined as 0.73 μm per 1000 pages.

SILSESQUIOXANE EXAMPLE

General Preparation of Silsesquioxane:

$$\text{“}SiO_2\text{”}+RSi(OR')_3 \rightarrow RSiO_{1.5} \qquad \text{(empirical formula)}$$

Where R' is an alkoxy group (methoxy, ethoxy, etc.) and R is typically an organic group (and/or an additional alkoxy group).

“$SiO_2$” can be an aqueous suspension of silica or formed in situ from $Si(OCH_2CH_3)_4$ (tetraethyl orthosilicate; TEOS). Synonyms for TEOS include tetraethoxysilane and orthosilicic acid tetraethyl ester. The reaction proceeds by hydrolysis of the alkoxysilane groups to form an alcohol and a Si—O—Si linkage.

Silsesquioxanes are highly cross-linked materials with the empirical formula $RSiO_{1.5}$. They are named from the organic group and a 1.5 (sesqui) stoichiometry of oxygen to silicon. A variety of representations have been made to represent the structure. Below are two of the simplest three-dimensional representations (see U.S. Pat. No. 3,944,520 to Andrianov et al.). The silsesquioxane is referred to as methylsilsesquioxane (MSQ) when the R groups are methyl groups.

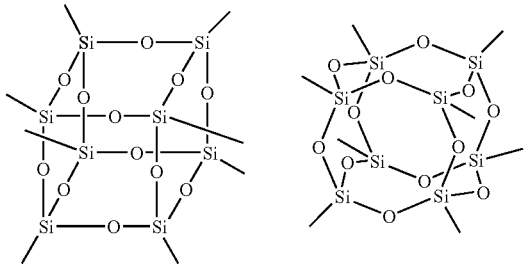

Which also is described by the following:

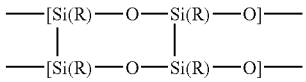

Note that silsesquioxanes can also be referred to as T-resins because each silicon has three oxygen atoms. Thus, $T_8$ refers to eight of these groups. The foregoing three-dimensional diagrams are two representations of a $T_8$ cube where R=methyl.

$$(CH_3SiO_{1.5})_8\ (T_8)$$

The prior art typically employs a combination of T (tri) and Q (quat) groups to form a modified silsesquioxane network. Note that these materials are still generally referred to as silsesquioxanes.

$$SiO_2 + CH_3Si(OCH_2CH_3)_3 \xrightarrow[\text{MSQ resin}]{} (CH_3SiO_{1.5})_x(SiO2)_y$$

In this case, the hydrolysis results in ethanol as a condensation byproduct.

In accordance with a specific embodiment of this invention, the UV absorber added as a substituent to the silsesquioxane is 4-[3-(triethoxysilylpropoxy]-2-hydroxybenzophenone (SHBP) which has the following nomenclature and structure:

$$C_6H_5C(O)C_6H_3(OH)—O(CH_2)_3Si(OCH_2CH_3)_3$$

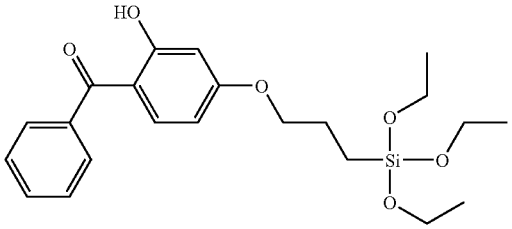

By adding this compound to the reaction of the foregoing mixture when undergoing hydrolysis this compound is cross-linked into the silsesquioxane resin. In effect, the organic UV absorber group replaces some of the methyl groups in the resin.

More generally is invention employs an overcoat layer of silsesquioxane substituted with a benzophenone group having the following general formula:

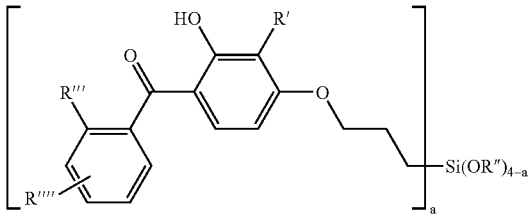

where R' is hydrogen, C1-C8 alkyl or halogen, R''' and R'''' are hydrogen, C1-C8 alkoxy, carboxy, halogen, hydrogen, amino, carbethoxy, or -Q-(CH2)3Si(OR'')3; Q is —NH— or —O—; R'' is C1-C8 alkyl; and a is an integer equal to 1-3 inclusive.

Specifically, the material obtained commercially is 4-[3-(triethoxysilylpropoxy]-2-hydroxybenzophenone chemically bonded in silsesquioxane These compounds can be made in accordance with the descriptions in the foregoing U.S. Pat. Nos. 4,278,804 and 4,443,579. It is sold as AS4000 from GE Silicones and is employed in the following Example 2.

EXAMPLE 2

Similar to Example 1. 180.0 g of 2-propanol and 175.6 g (0.84 mol) of tetraethyl orthosilicate was added to 200.27 g of the prepared urethane prepolymer described above. Then, 10.0 mL of 37% hydrochloric acid was diluted with 55.7 mL of deionized water and added to the reaction mixture. The solution was stirred for 2 days at room temperature. 133.11 g of the mixture was diluted with 200.3 g of 2-propanol and mixed with 67.3 g of AS4000 from GE Silicones. A photoconductor drum consisting of a CTL over a CGL on an anodized A1 core was then coated with the above solution and cured at 100° C. for 1 hour. An eddy current test system was used to measure the film thickness to be 1.5 μm.

The overcoat drum was then tested in a LEXMARK C750 color laser printer. The drum, tested in a two page and pause mode, showed good print quality with insignificant PC wear over 30,000 prints. The drum showed minimal wear and little or no change in film thickness. The wear was determined to be 0.00 μm per 1000 pages. This compares very favorably to a control drum without the overcoat layer (identical CG and CT layers, CT layer having polycarbonate bonder), where the wear rate was determined as 0.73 μm per 1000 pages.

COMPARATIVE EXAMPLES 75 grams of 20 wt. % solution of SHC1200, a silsesquioxane precursor solution from GE Silicones, was diluted with 225 grams of isopropanol to form a 5 wt. % solution. Photoconductor drums consisting of a CTL over a CGL on an anodized A1 core were then coated with the diluted solution and cured at 100° C. for 1 hour. An eddy current test system was used to measure the film thickness to be 0.5 μm. A similar product from GE Silicones, SHC5020, was also diluted to 5% and then coated onto another photoconductor drum. These two overcoated drums were tested in a LEXMARK C750 color laser printer and shown to have similar wear properties to the overcoats in the current invention. While the wear profiles are very similar, these drums exhibit approximately 60 V greater loss in mobility per micron compared to the overcoat in Example 1 and about 80 V greater loss in mobility compared to the overcoat blend in Example 2 of the present invention. These comparative examples do not include a soft polyurethane segment or the UV absorber. Furthermore, the combination of the soft polyurethane segment with the methylsilsesquioxane resin (AS4000) appears to have a synergistic effect to improve mobility further(see Table 1 below). Because both the hybrid organic-inorganic overcoats and the combination with the methylsilsequioxane resin improve the mobility, thicker overcoat layers can be prepared, without detrimentally affecting the photoconductor.

TABLE 1

Effect of overcoats on mobility on a standard photoconductor formulation.

| Overcoat Type | Delta Residual Voltage/Micron |
|---|---|
| Example 1 | −59 V |
| Example 2 | −37 V |
| AS4000 | −77 V |
| SHC1200 | −113 V |
| SHC5020 | −126 V |

Crazing Test. Overcoated photoconductor drums from Examples 1 and 2 were tested for crazing along with a standard photoconductor drum (no overcoat) as a control, which contained N,N'-Bis-(3-methylphenyl)-N,N'-bis-phenylbenzidine (TPD) in the CTL. An accelerated experiment was conducted at 60° C. in an oven by two techniques: 1) touching the PC drum surface with a finger and 2) putting a drop of hand lotion on the PC drum. The CTL of the overcoated PC drum was protected from crazing, presumably by inhibiting contact or penetration of the oils or lotion with the CTL. On the other hand, the CTL of the control PC drum crazed within a few hours.

The foregoing examples are illustrative as various ceramer blends are consistent with the foregoing descriptions of this invention.

The invention claimed is:

1. A photoconductor overcoated with a polyurethane-silsesquioxane ceramer hybrid material, said silsesquioxane being substituted with a hydrolyzed benzophenone having the following general formula:

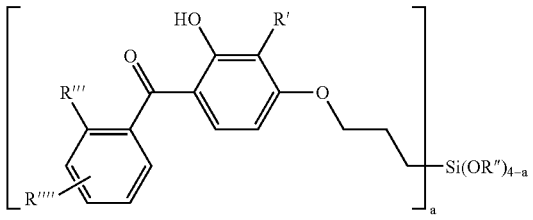

where R' is hydrogen, $C_1$-$C_8$ alkyl or halogen, R''' and R'''' are hydrogen, $C_1$-$C_8$ alkoxy, carboxy, halogen, hydrogen, amino, carbethoxy, or Q-$(CH_2)_3Si(OR'')_3$; Q is —NH— or —O—; R'' is $C_1$-$C_8$ alkyl; and a is an integer equal to 1-3 inclusive.

2. The photoconductor as in claim 1 in which said ceramer hybrid material is 0.1 to 5 microns thick.

3. The photoconductor as in claim 2 in which said ceramer hybrid material is about 0.5 to about 2 microns thick.

4. The overcoated photoconductor of claim 1 in which said hydrolyzed benzophenone substitutes said silsesquioxane in amount of about one said benzophenone-containing group for every 4 to 10 methyl substituted silicon groups.

5. The photoconductor as in claim 4 in which said ceramer hybrid material is 0.1 to 5 microns thick.

6. The photoconductor as in claim 5 in which said ceramer hybrid material is about 0.5 to about 2 microns thick.

7. A photoconductor overcoated with a polyurethane-silsesquioxane ceramer hybrid material, said silsesquioxane being substituted with hydrolyzed 4-[3-triethoxysilylpropoxy]-2-hydroxybenzophenone (SHBP).

8. The photoconductor as in claim 7 in which said ceramer hybrid material is 0.1 to 5 microns thick.

9. The photoconductor as in claim 8 in which said ceramer hybrid material is about 0.5 to about 2 microns thick.

10. The overcoated photoconductor of claim 7 wherein said SHBP substitutes said silsesquioxane in amount of about one said SHBP molecule for every 4 to 10 methyl substituted silicon group.

11. The photoconductor as in claim 10 in which said ceramer hybrid material is 0.1 to 5 microns thick.

12. The photoconductor as in claim 11 in which said ceramer hybrid material is about 0.5 to about 2 microns thick.

13. The photoconductor as in claim 12 in which said ceramer is about 1.5 microns thick.

* * * * *